United States Patent [19]

Rudick

[11] Patent Number: 5,000,351

[45] **Date of Patent: * Mar. 19, 1991**

[54] CONCENTRATE DISPENSING SYSTEM FOR A POST-MIX BEVERAGE DISPENSER

[75] Inventor: Arthur G. Rudick, Marietta, Ga.

[73] Assignee: The Coca-Cola Company, Atlanta, Ga.

[ * ] Notice: The portion of the term of this patent subsequent to Nov. 24, 2004 has been disclaimed.

[21] Appl. No.: 93,758

[22] Filed: Sep. 8, 1987

Related U.S. Application Data

[62] Division of Ser. No. 842,287, Mar. 21, 1986, Pat. No. 4,708,266.

[51] Int. Cl.[5] ..... B65D 35/56

[52] U.S. Cl. ..... 222/105; 222/132; 222/135; 222/214; 222/459; 222/325

[58] Field of Search ..... 222/105, 129.1, 132, 222/135, 144.5, 214, 459, 325; 239/406; 417/474–477

[56] References Cited

U.S. PATENT DOCUMENTS

| | | | |
|---|---|---|---|
| 2,462,019 | 2/1949 | Bowman et al. | 222/136 |
| 2,831,610 | 4/1958 | Dennie | 222/183 |
| 3,323,681 | 6/1967 | Vette et al. | 222/129.1 |
| 3,831,854 | 8/1974 | Sato et al. | 239/406 |
| 4,135,647 | 1/1979 | Mascia et al. | 222/325 |
| 4,266,726 | 5/1981 | Brown et al. | 222/129.1 |
| 4,708,266 | 11/1987 | Rudick | 222/105 |
| 4,753,370 | 6/1988 | Rudick | 222/105 |

*Primary Examiner*—H. Grant Skaggs

*Attorney, Agent, or Firm*—Birch, Stewart, Kolasch & Birch

[57] ABSTRACT

A post-mix beverage dispensing system includes a completely disposable concentrate dispensing assembly, a non-disposable mixing nozzle structure which mixes concentrate and water without permitting the concentrate to touch any nozzle walls and a valving system which permits a single peristaltic pump wheel to selectively dispense concentrate from one of a plurality of concentrate supplies operatively associated with the single pump wheel.

6 Claims, 6 Drawing Sheets

CONCENTRATE DISPENSING SYSTEM FOR A POST-MIX BEVERAGE DISPENSER

This application is a divisional of copending application Ser. No. 842,287, filed on Mar. 21, 1986, now U.S. Pat. No. 4,708,266.

The present invention relates to a concentrate dispensing system for a post-mix beverage dispenser. More specifically, the present invention relates to a concentrate dispensing system, including disposable components within a concentrate dispensing assembly, said dispenser being suitable for use in a home refrigerator or the like.

Heretofore, post-mix beverage dispensers have utilized syrup packages wherein the syrup is formed predetermined proportions. Conventional ratios (water to syrup ratio to produce a finished drink) are in the neighborhood of 5:1. If it were possible to utilize an artificially sweetened concentrate with a much higher reconstitution ratio (50:1 or higher), a substantial space savings would be achieved for the storage space required to contain concentrate packages or containers within a given dispensing system.

Furthermore, conventional post-mix beverage dispensers are often difficult to clean or sanitize and are prone to flavor carry-over. To alleviate this problem, some attempts have been made in the past to make as much of the concentrate dispensing assembly of the beverage dispensing system as possible disposable, so that these sanitation requirements and flavor carry-over problems are minimized. An example of such a post-mix beverage dispenser is described in U.S. Pat. No. 3,750,908 to Bauerline, issued Aug. 7, 1973. However, in the Bauerline dispenser the mixing of concentrate and water occurs within a non-disposable nozzle, so the concentrate touches the nozzle sidewalls and requires subsequent cleaning thereof at periodic intervals. If the contact of concentrate with any of the non-disposable components of a beverage dispenser can be precluded, the beverage dispenser would require very little sanitation.

SUMMARY OF THE INVENTION

Accordingly, it is a primary object of the present invention to provide a post-mix beverage dispenser which functions very well with artificially sweetened concentrate, with a much higher reconstitution ratio than that of of conventional beverage syrups, to achieve a substantial space savings for concentrate storage.

It is a further object of the present invention to provide a post-mix beverage dispenser with a totally disposable concentrate dispensing assembly in order to minimize sanitation and flavor carryover problems of the dispenser.

It is another object of the present invention to provide an improved mixing nozzle structure for a post-mix beverage dispenser which directs agitated water and concentrate to an isolated area outboard of the nozzle, so that the concentrate never touches the nozzle walls in order to minimize the need for subsequent cleaning of the nozzle.

It is yet another object of the present invention to provide an improved concentrate container adaptable for operative association with a peristaltic pump which pumps concentrate from the container.

It is still a further object of the present invention to provide a concentrate dispensing system including a single peristaltic pump which can selectively pump concentrate from a plurality of concentrate containers in a multi-flavor beverage dispensing system.

These and other objects of the present invention are achieved by providing a post-mix beverage dispenser, including a water supply assembly, a concentrate supply assembly, and a mixing assembly for mixing water from the water supply assembly and concentrate from the concentrate supply assembly together to form the post-mix beverage, the improvement in such a dispenser comprising:

peristaltic pump means having a rotary pumping member;

the concentrate supply assembly being disposable and including, a disposable concentrate container, and disposable, flexible conduit means connecting said concentrate container to said mixing assembly and being disposed in operative engagement with said rotary pump member to cause concentrate in the container to be pumped through the conduit means to the mixing assembly;

nozzle means within the mixing assembly coupled to the water supply assembly for directing the water to an isolated mixing area out of contact with any surfaces of the dispenser; and means for directing concentrate pumped through the conduit means into contact with the water at the isolated mixing area;

whereby the water and concentrate are mixed together to form a post-mix beverage and the concentrate is precluded from contacting any portions of the water supply or mixing assemblies of the dispenser.

The improved nozzle structure of the present invention comprises: a substantially frustoconical housing having an input end for the concentrate and water and a discharge opening at an output end thereof, the housing having an axial bore extending from the input end to the discharge opening; a toroidal chamber at the input end of the housing having an inlet conduit for the water tangentially disposed with respect thereto, to create a swirling of the water in the chamber; means for directing the water from the toroidal chamber through the housing concentrically about the axial bore and out of the discharge opening to convergence at the isolated area outboard of the nozzle; and means for directing a stream of concentrate from the input end along the longitudinal axis of the housing through the axial bore to the mixing area, the diameter of the stream being less than the diameter of the axial bore to preclude the concentrate from contacting any surfaces of the nozzle housing.

The improved concentrate supply assembly for the post-mix beverage dispenser of the present invention comprises: a container for concentrate having a base with a discharge opening through which concentrate flows by the force of gravity and a rigid, curved exterior surface adjacent to the discharge opening; a flexible conduit coupled to the discharge opening extending across, and in contact with, the curved exterior surface; and peristoltic pump means having a rotary pumping member with the periphery thereof in operative engagement with the conduit in regions opposite to the curved external surface, to pinch the conduit against the curved external surface and pump concentrate through the conduit.

The system of the present invention also provides for the dispensing of a plurality of flavors from different respective concentrate containers, utilizing a single peristaltic pump in common to, and operatively associated with, each of the containers. This is made possible by the use of a three-way valve in fluid circuit with the respective flexible conduits which output concentrate from each of the respective containers. The three-way valve has an inlet port, and first and second outlet ports, the inlet port being coupled to the associated conduit of the concentrate container, the first outlet port being coupled to a recirculation conduit in fluid communication with the interior of the associated container, and the second outlet port being coupled to an outlet conduit extending to a mixing assembly of the dispenser, the valve means having a valve member movable between first and second positions for selectively connecting the inlet port with either the first or second outlet ports. A selector switch is provided in association with each of the respective three-way valves for actuating the valve to move the valve member between the respective first and second positions to cause a selected flavor of the respective concentrates within the containers to be transported to the mixing station of the post-mix beverage dispenser.

BRIEF DESCRIPTION OF THE DRAWINGS

The objects of the present invention and the attendant advantages thereof will become more readily apparent by reference to the drawings, like reference numerals referring to like parts, and wherein:

FIG. 3A is a top plan view of the nozzle of FIG. 3;

FIG. 3B is a cross sectional view taken along lines 3B—3B of FIG. 3;

FIG. 3C is a cross-sectional view taken along lines 3C—3C of FIG. 3;

DETAILED DESCRIPTION OF PREFERRED EMBODIMENTS

Figure 1:
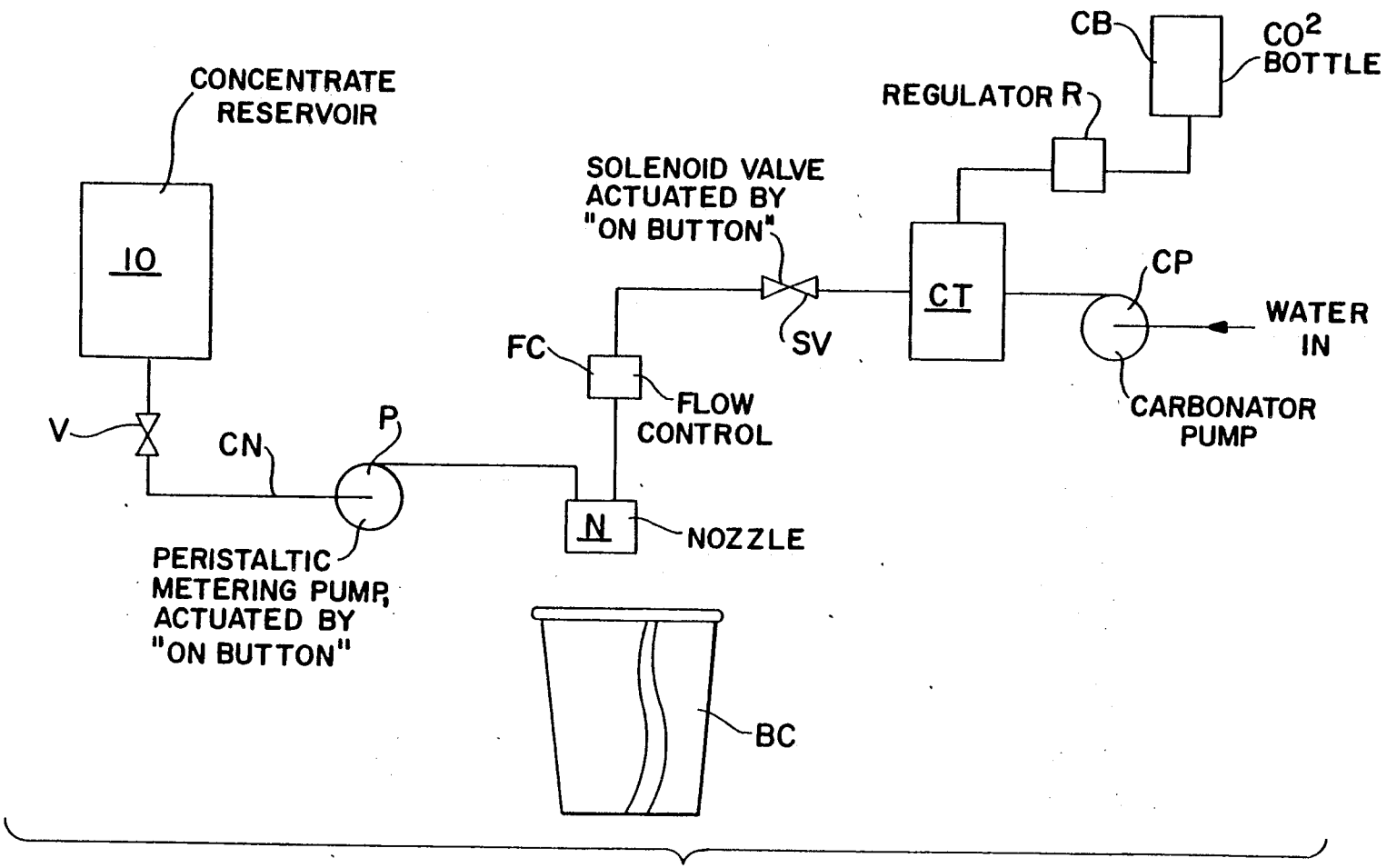
FIG. 1 is a schematic block diagram of a single-flavor post-mix dispensing system employing the concentrate dispensing system of the present invention.

Referring to FIG. 1, there is illustrated a post-mix beverage dispensing system for making a post-mix beverage of a selected single flavor, including a concentrate reservoir 10 coupled through a valve V to a flexible concentrate conduit CN. The flexible concentrate conduit is operatively associated with a peristaltic pump P in a manner to be described more fully hereinafter with reference to FIG. 2. The flexible concentrate conduit CN extends to a mixing nozzle N to supply concentrate to an isolated mixing area, as will be described more fully with reference to FIGS. 3. Also illustrated in FIG. 1 is a conventional water supply assembly for transporting carbonated water to the nozzle N. It may include, for example, a $CO_2$ bottle CB coupled through a pressure regulator R, which leads to a carbonator tank CT. Water is supplied to the carbonator tank CT from a carbonator pump CP or a commercial water supply, if available. It should be apparent from reference to FIG. 1 that the nozzle N causes the concentrate and carbonated water to be combined together in predetermined proportions for the creation of a post-mix beverage within a serving cup BC.

Figure 2:
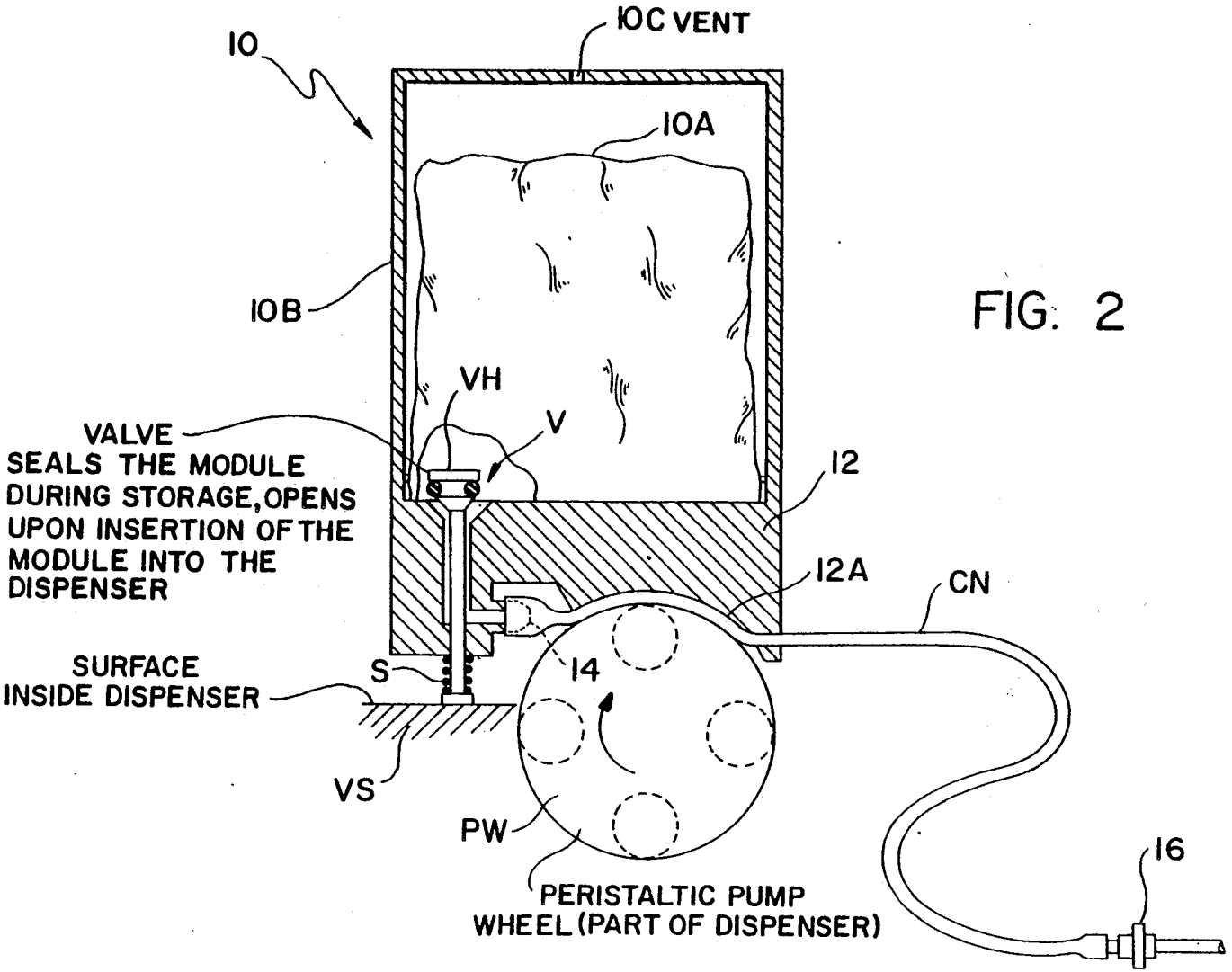
FIG. 2 is a diagrammatic side-elevational view of a concentrate dispensing system according to the present invention illustrating a concentrate dispenser in cross-section, a flexible conduit connected to the container, and the operative association of a peristaltic pump wheel with the flexible conduit.

FIG. 2 illustrates the interaction of the peristaltic pump P and the flexible concentrate supply conduit CN in the concentrate dispensing assembly of the present invention. As illustrated in FIG. 2, the concentrate container 10 may include a rigid outer shell 10B and an inner collapsible bag 10A. Rigid outer shell 10B is also provided with a vent 10C. The collapsible bag 10A contains the concentrate to be dispensed and may be sealed to the periphery of the bottom 12 of container 10 so that the concentrate therein is in fluid communication with a valve V. Valve V has a head VH and a stem VS extending through a bore in bottom 12, the bore being connected to a horizontal passage, terminating in a nipple 14. The valve stem also has a coil spring S around a portion of the stem VS extending beyond the bottom 12 of the container 10. Spring S normally biases the valve head VH to a closed position to preclude the dispensing of concentrate out of the discharge bore through nipple 14. However, when the container 10 is inserted into a dispenser and the outboard end of the valve stem VS contacts a surface inside the dispenser, as illustrated, the valve V is forced into the open position illustrated to permit concentrate to pass through the discharge bore and passage to the nipple 14. The flexible conduit CN has a first end secured to the nipple 14 and a second end secured to an injector 16 to be snapped into the nozzle structure of FIG. 3, to be discussed hereinafter. As illustrated in FIG. 2, conduit CN passes over a curved surface 12A in the bottom of container 10 into operative engagement with the periphery of peristaltic pump wheel PW when container 10 is inserted into the dispenser. Accordingly, as peristaltic wheel PW rotates, the flexible conduit CN is pinched against the curved surface 12A to positively displace and pump concentrate through the conduit to the injector 16. As illustrated in FIG. 2, surface 12A in the bottom of the container 10 has a complementary shape to the exterior or peripheral surface of the peristaltic pump wheel PW.

Figure 3:
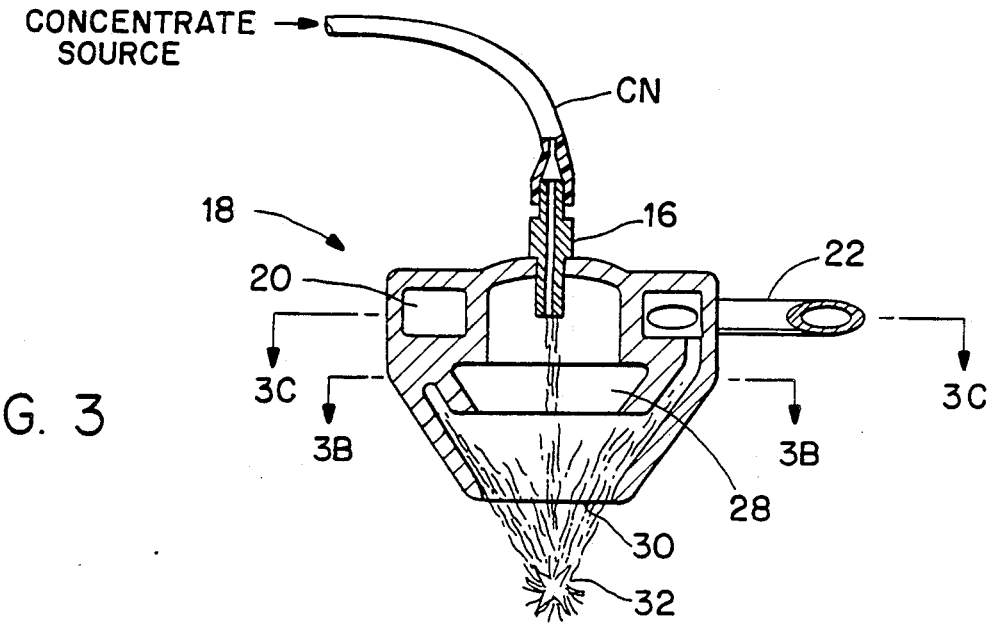
FIG. 3 and related
Figure 3A:
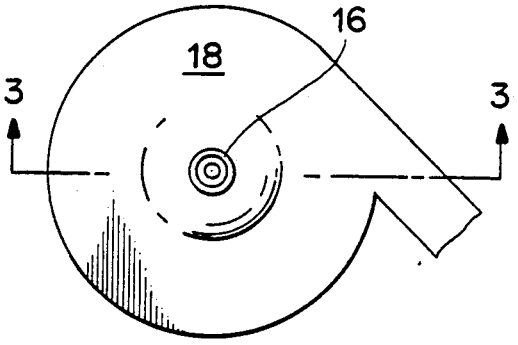
FIGS. 3A to 3C illustrate the mixing nozzle assembly of the present invention.
Figure 3B:
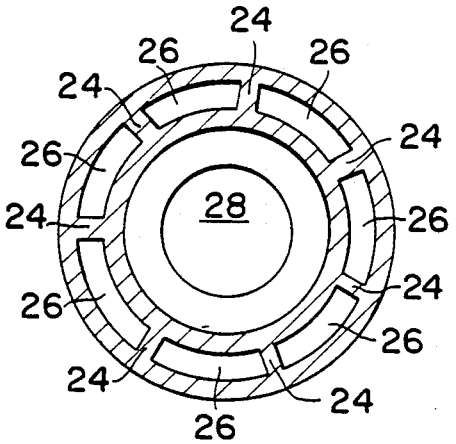
Figure 3C:
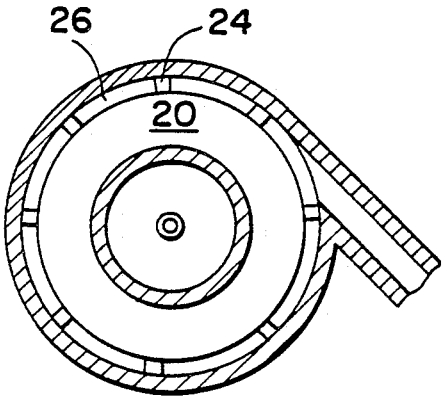

Referring to FIG. 3, and associated FIGS. 3A to 3C, there is illustrated the mixing assembly and nozzle structure of the present invention, suitable for use in the concentrate dispensing system of FIG. 1. As illustrated in these Figures, the nozzle includes a frustoconical housing 18, including an input end with a toroidal plenum 20, which surrounds an axial bore 28 extending through the nozzle structure. Still water or carbonated water, such as from the water supply assembly of FIG. 1, is introduced through a tangentially disposed conduit 22 into the torodial plenum 20 to create a swirling action of the water. The water then passes down through passages 26 defined between radial partitions 24, and out of the discharge opening 30 of the nozzle to an isolated outboard mixing area 32. Meanwhile, as illustrated in FIG. 3, concentrate is supplied through the injector 16 mounted coaxially with the bore 28 at the input end of the nozzle housing to direct concentrate down the axis of the bore without touching any of the surfaces of the nozzle housing 18 until the concentrate converges at isolated area 32 with the water. Since the water has had a swirling action imparted thereto within the torodial plenum 20, the concentrate and water will mix well together at the isolated area 32 just before falling into a beverage serving cup, such as BC of FIG. 1.

The nozzle structure of FIGS. 3 is particularly advantageous in that the concentrate supplied through the flexible conduit CN does not touch any of the surfaces of the nozzle housing 18, and therefore precludes the need for any frequent sanitization of the nozzle housing 18. This also prevents flavor carry-over.

The concentrate assembly illustrated in FIG. 2 is totally disposable with the exception of the peristaltic pump wheel PW. Therefore, the sanitization and flavor carry-over problems normally associated with concentrate dispensing systems are eliminated. Furthermore, the concentrate package 10 of FIG. 2, including the sealed collapsible bag 10A, makes it possible to remove a partially empty concentrate container from the system of FIG. 1, store the container within the refrigerator or elsewhere until further use is desired, and then reuse the concentrate container. This ability to store and reuse the container is also enhanced by the spring-loaded valve V in the bottom of the container 10 which automatically seals the container when it is lifted out of the dispenser.

The concentrate dispensing system described with reference to FIGS. 1 to 3 above is a singleflavor system, but it should be understood that its structure and principles of operation are also easily adaptable to multi-flavor systems, such as illustrated in FIGS. 4 to 7, to be discussed hereinafter.

Figure 4:
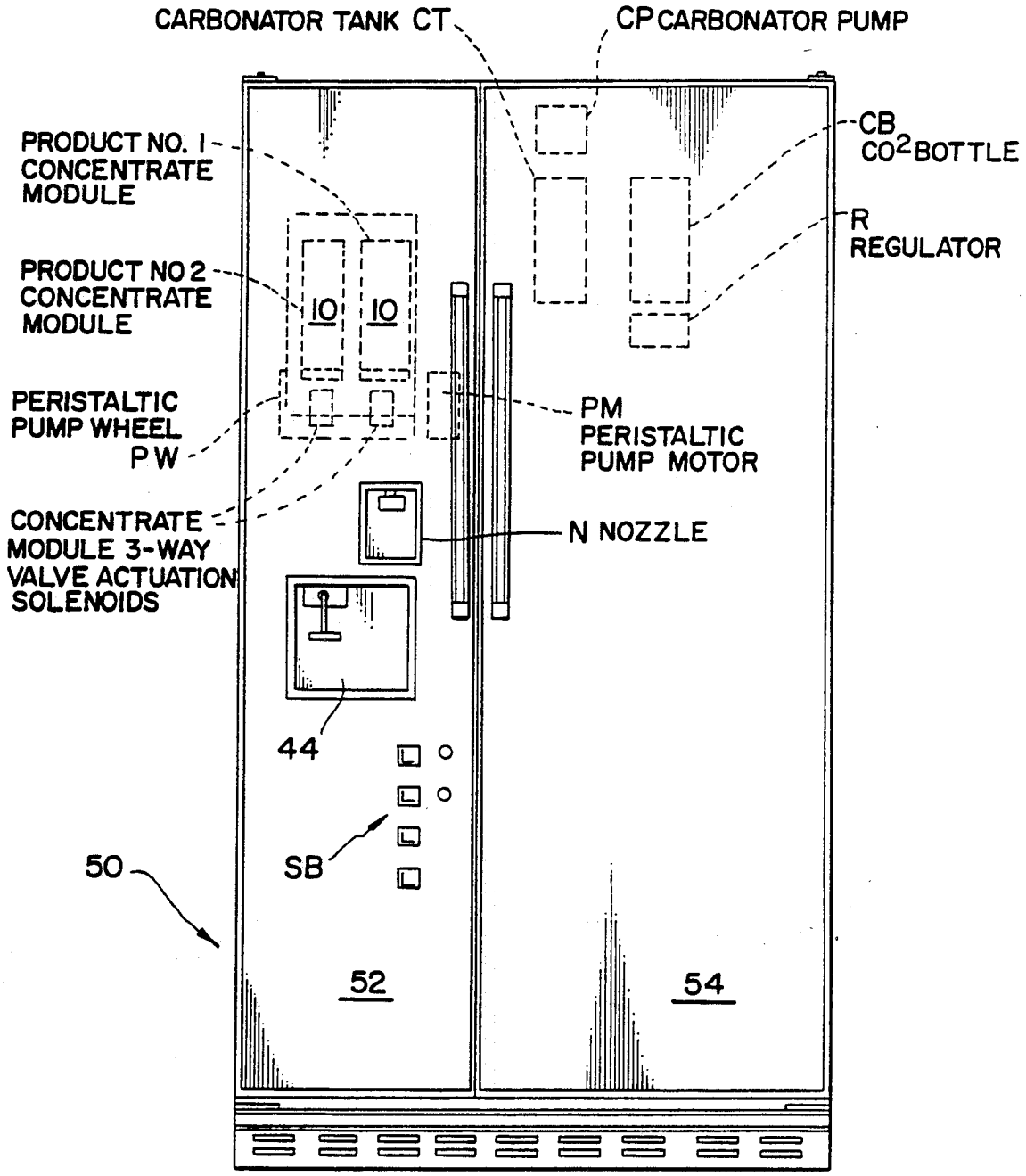
FIG. 4 is a diagrammatic illustration of how the concentrate dispensing assembly and post-mix beverage dispensing system of the present invention could be mounted in the respective freezer and refrigerator doors of a home refrigeration device.

FIG. 4 illustrates a concentrate dispensing system according to the principles of the present invention mounted within a conventional home refrigerator 50. As illustrated, the concentrate dispensing assembly portion of the system may be mounted in a freezer door 52. This is particularly advantageous for chilling the concentrate, and is feasible due to the very high concentrate-to-water ratio made possible by the unique system design. As illustrated, the concentrate dispensing nozzle N is mounted in a through-the-door arrangement in a similar fashion to a conventional water serving station 44. Also mounted within the door is a cylindrical peristaltic pump wheel PW, the longitudinal axis thereof extending horizontally, two or more concentrate supply containers 10 disposed side-by-side along the longitudinal axis of peristaltic pump wheel PW, and associated three-way solenoid actuated valves 34, to be discussed in conjunction with the description of FIGS. 5 and 7. The water supply assembly, including a carbonator tank CT, carbonator pump CP, $CO_2$ bottle CB and regulator R of the type illustrated in FIG. 1 are illustrated in FIG. 4 as being mounted in the regular refrigerator door section 54 of the refrigeration device 50.

Figure 5:
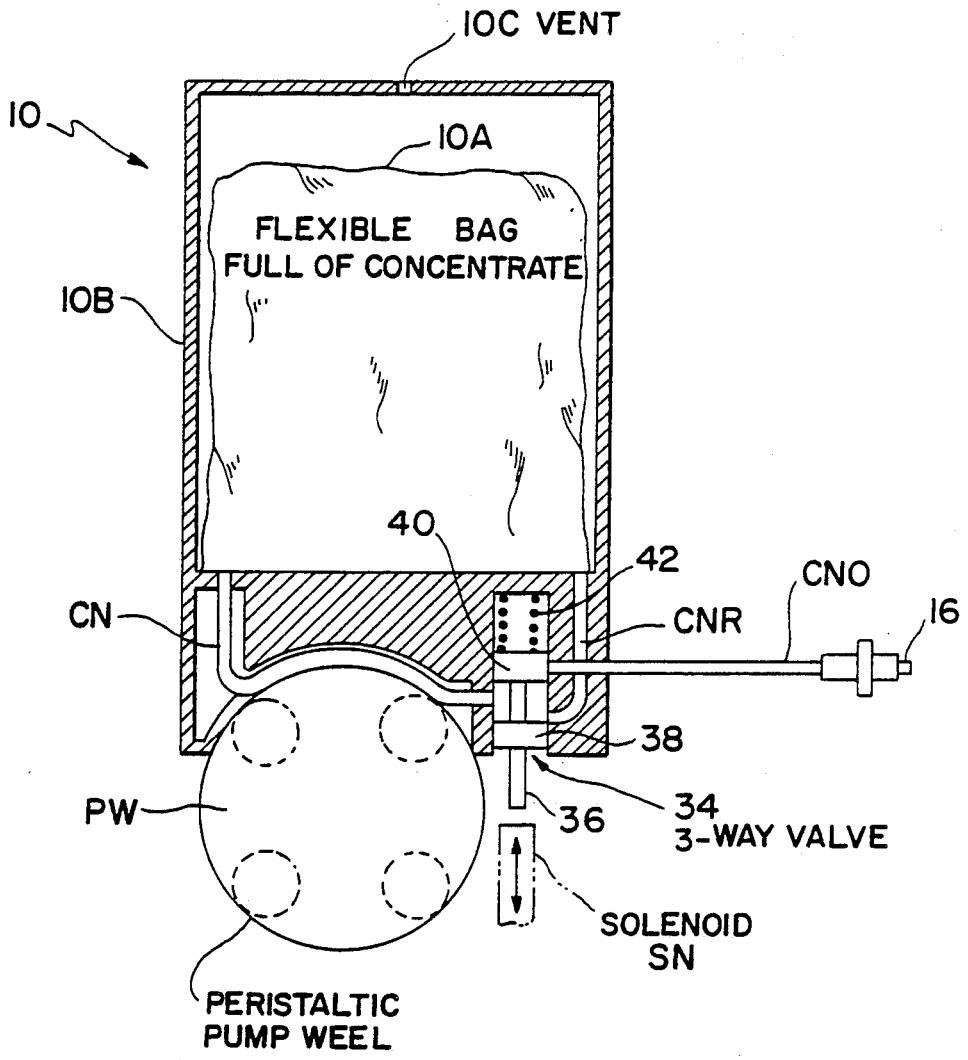
FIG. 5 is a side elevation partially in cross section, illustrating a concentrate dispenser of the present invention and an associated threeway valve to be utilized in the multi-flavor postmix beverage dispensing system of FIG. 7.
Figure 6:
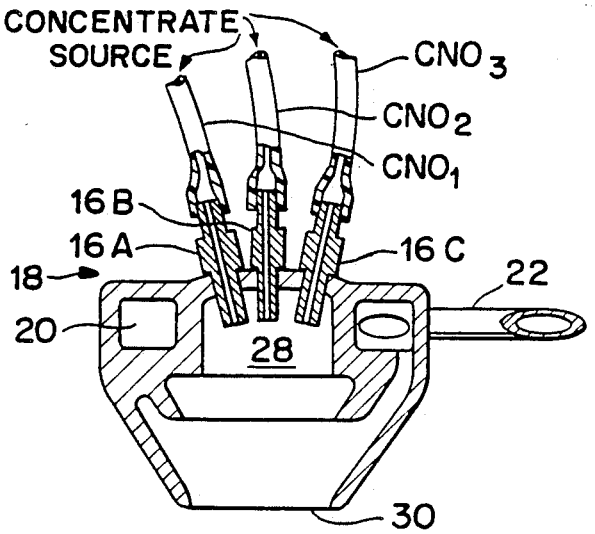
FIG. 6 is a side elevational view in cross section, illustrating how a plurality of concentrate dispensing conduits, similar to the single conduit illustrated in FIG. 3, could be inserted into the novel mixing nozzle structure for use in the multi-flavor system of FIG. 7.
Figure 7:
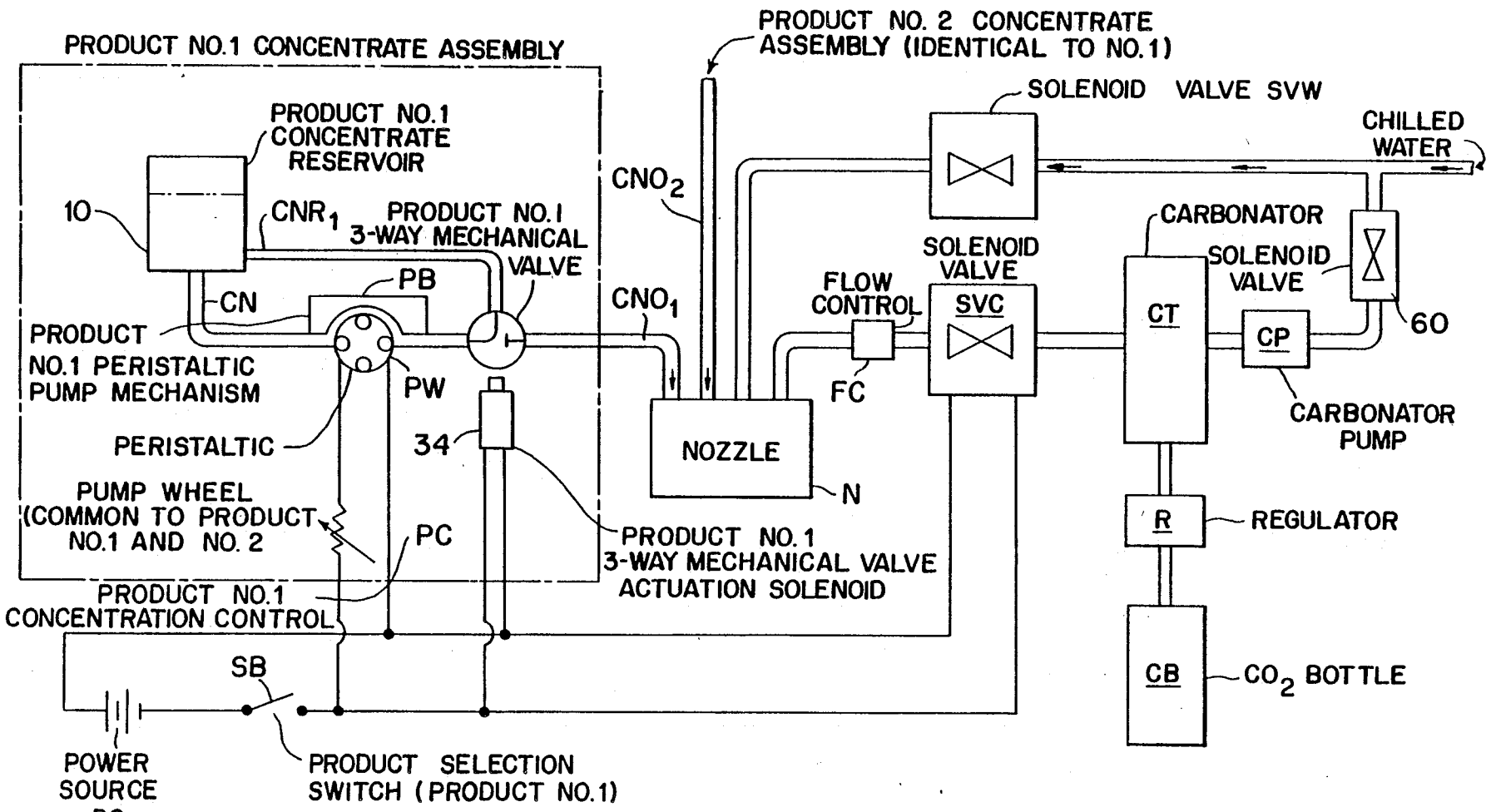
FIG. 7 is a schematic block diagram of a multi-flavor, post-mix beverage dispensing system utilizing the concentrate dispensing assembly of the present invention.

The operation of a multi-flavor concentrate dispensing system of the type illustrated in FIG. 4 may be best understood by reference to FIGS. 5 to 7. In order to make the concentrate dispensing system portion of the system compact enough to fit within a confined space, such as the freezer door of a conventional refrigerator, it is a unique feature of the present invention to utilize only a single peristaltic pump for pumping flavor concentrate from a plurality of concentrate containers 10. In order to make this possible, the present invention utilizes a three-way solenoid actuated valve 34 in series with the flexible output conduit CN of each of the respective flavor concentrate containers 10. Such a valve is illustrated diagramatically in FIG. 7, and the specific structure thereof in FIG. 5.

Referring to FIG. 7, such a three-way valve 34 is disposed at the output side of the peristaltic pump wheel in the flexible supply conduit $CNO_1$. The three-way valve has an input port coupled to the flexible conduit CN and two output ports, one of which communicates with concentrate output supply conduit $CNO_1$ extending to nozzle N, and the other of which is coupled to a concentrate recirculation conduit CNR1, leading to the inside of the collapsible bag 10A (not shown) in the concentrate container 10. The peristaltic pump wheel and the associated motor (not shown in FIG. 7 but see FIG. 4, PM) are provided with electrical power from a power source PS upon actuation of a product selection switch SB. Variable resistor PC is provided to adjust the speed of the peristaltic pump motor PM, and therefore the speed of rotation of the peristaltic pump wheel PW to selectively control the amount of concentrate dispensed for a given post-mix beverage during the period that the product selection switch SB is held down. The concentration of the finished drink can thereby be adjusted to the tastes of an individual user. It should be noted in the illustration of FIG. 7 that the concentrate supply assembly for only one flavor of concentrate is illustrated in detail for clarity. However, additional, similar concentrate supply assemblies would be provided for the supply of concentrate through additional flexible conduits $CNO_2$, $CNO_3$, etc., to the nozzle N.

An advantage of the multi-flavor system of the present invention is that the concentrate supply assemblies may utilize a common, cylindrical peristaltic pump wheel PW for operatively engaging the respective flexible concentrate supply conduits CN by virtue of the fact that concentrate may be selectively output from any of the concentrate supply assemblies depending on the condition of the three-way solenoid actuated valves 34.

The operation of three-way valves 34 may be best understood by reference to FIG. 5. As illustrated in FIG. 5, the three-way valve 34 may have a pair of valve elements 38, 40 mounted on a common stem 36 in operative association with an input port coupled to flexible conduit CN and output conduits coupled to flexible conduits CNO and CNR, respectively. As illustrated in FIG. 5, when the valve is in the position shown, and peristaltic pump wheel PW is rotating, concentrate is positively displaced through flexible conduit CN into the input port of valve 34 and out the output port coupled to recirculation conduit CNR into the interior of flexible bag 10A. When the valve is in this position, concentrate will merely recirculate in a closed loop, and no concentrate will be dispensed through flexible conduit CNO to the concentrate injector structure 16. However, when the solenoid valve 34 is actuated to depress stem 36 upwardly, against the force of spring 42, the valve element 38 will close the output port leading to the recirculation conduit CNR and valve element 40 will open the valve outlet port leading to the concentrate output conduit CNO. Accordingly, in this position, concentrate will flow to the injector 16. Accordingly, a single peristaltic pump and associated cylindrical wheel PW may be utilized with a plurality of respective flexible conduits leading to concentrate containers of different flavors and selective dispensing of the concentrate in the respective containers can be affected by actuation of a product selection switch such as SB in FIG. 7 to energize the solenoid-actuated valve 34 in the concentrate dispensing sub-assembly having the desired flavor of the beverage to be dispensed.

Referring to FIG. 6, a three or more flavor system may be provided if desired wherein a plurality of injectors such as 16A, 16B, and 16C snapped into ports in the input end of housing 18 for injection concentrate into the axial bore 28 of the dispensing nozzle. Each of the respective injectors are coupled to associated flexible concentrate supply conduits such as $CNO_1$, $CNO_2$, and $CNO_3$ from subassemblies similar to that illustrated in FIG. 7.

Other variations may be made to the system of the present invention as desired. For example, although it is preferable to have the peristaltic pump wheel PW operatively associated with a rigid bottom portion of a concentrate container having a complementary-shaped exterior surface, the curved surface may be provided on a separate block such as PB illustrated in FIG. 7. Also, the water supply assembly may have the capability of supplying either chilled still water or chilled carbonator water, as desired. As illustrated in FIG. 7, chilled still water may be supplied through a solenoid valve SVW to the nozzle N or, in the alternative, chilled carbonator water may be supplied from the carbonator tank CT through a solenoid valve SVC and a flow control valve FC to the nozzle N. The carbonated water system in the illustration of FIG. 7 is supplied by water through a solenoid valve 60, and carbonator pump CP. Carbon dioxide gas is supplied to the carbonator tank CT from a $CO_2$ bottle CB and a pressure regulator R.

It should be understood that the system of the present invention may be further modified as would occur to one of ordinary skill in the art without departing from the spirit and scope of the present invention.

What is claimed is:

1. In a post-mix beverage dispenser including a water supply assembly, a concentrate supply assembly and a mixing assembly for mixing water from the water supply assembly and concentrate from the concentrate supply assembly together to form the post-mix beverage, the improvement comprising:

(a) peristaltic pump means having a rotary pumping member;

(b) the concentrate supply assembly being disposable and including, 1. a disposable concentrate container; and 2. disposable flexible conduit means connecting said concentrate container to said mixing assembly and being disposed in operative engagement with said rotary pump member to cause concentrate in the container to be pumped through the conduit means to the mixing assembly;

(c) nozzle means within the mixing assembly coupled to the water supply assembly for directing the water to an isolated mixing area out of contact with any surfaces of the dispenser, said nozzle means including 1. a housing having an input end for the water and concentrate, and a discharge opening at an output end thereof, said housing having an axial bore extending from the input end to the discharge opening, 2. a toroidal chamber at said input end of the housing having an inlet conduit for said water tangentially disposed with respect thereto to create a swirling of the water in said chamber, 3. means for directing said water from said toroidal chamber through the housing concentrically about the axial bore and out of said discharge opening to convergence at the isolated area outboard of the nozzle, and 4. means for directing a stream of the concentrate from the input end along the longitudinal axis of the housing through said axial bore to said mixing area, the diameter of the stream being less than the diameter of the axial bore to preclude the concentrate from contacting any surfaces of the nozzle housing; and whereby the water and concentrate are mixed together to form a post-mix beverage and the concentrate is precluded from contacting any portions of the water supply or mixing assemblies of the dispenser.

2. The dispenser of claim 1 wherein the disposable concentrate container has an external surface portion with a complementary shape to an external surface of the rotary member of the peristaltic pump, and the disposable flexible conduit means is operatively engaged between said surface portion and said external surface.

3. The dispenser of claim 2 wherein said rotary pumping member has a circular external surface.

4. The dispenser of claim 2 wherein said disposable container includes a rigid outer shell, a portion of which forms said surface portion, and a sealed collapsible bag within said rigid outer shell, said bag having a discharge opening in fluid communication with said disposable flexible conduit means through a valve means.

5. The dispenser of claim 4 wherein said surface portion with the complementary shape is disposed on a bottom wall of the rigid shell and said valve means is disposed in said bottom wall adjacent said surface portion with an actuator stem extending from said bottom into contact with a stationary support surface, whereby the weight of said container causes the support surface to depress said stem to open said valve means when said surface portion with said complementary shape operatively engages the conduit means.

6. The nozzle of claim 1, wherein said nozzle means for directing the water includes a plurality of radial vanes defining spaced ports about the circumference of the housing, said ports converging toward the longitudinal axis of said housing in a direction extending from said toroidal chamber to the discharge opening.

* * * * *